US009969577B2

(12) United States Patent
Eguchi

(10) Patent No.: US 9,969,577 B2
(45) Date of Patent: May 15, 2018

(54) SHEET LOADER AND IMAGE FORMING APPARATUS INCORPORATING THE SHEET LOADER

(71) Applicant: Yosuke Eguchi, Tokyo (JP)

(72) Inventor: Yosuke Eguchi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days. days.

(21) Appl. No.: 15/436,636

(22) Filed: Feb. 17, 2017

(65) Prior Publication Data

US 2017/0255153 A1 Sep. 7, 2017

(30) Foreign Application Priority Data

Mar. 2, 2016 (JP) ..... 2016-040113

(51) Int. Cl.
*B65H 3/66* (2006.01)
*B65H 1/04* (2006.01)

(52) U.S. Cl.
CPC ..... *B65H 1/04* (2013.01); *B65H 3/66* (2013.01); *B65H 2405/114* (2013.01); *B65H 2511/10* (2013.01)

(58) Field of Classification Search
CPC .. B65H 3/66; B65H 2511/10; B65H 2405/114
USPC ..... 271/171
See application file for complete search history.

(56) References Cited

U.S. PATENT DOCUMENTS

| | | | | |
|---|---|---|---|---|
| 6,669,188 | B1 * | 12/2003 | Marasco | B65H 1/04 271/145 |
| 7,533,880 | B2 * | 5/2009 | Kawanishi | B65H 1/266 271/171 |
| 7,559,548 | B2 * | 7/2009 | Dobrindt | B65H 1/04 271/171 |
| 9,725,263 | B2 * | 8/2017 | Takai | B65H 1/266 |
| 2011/0262198 | A1 * | 10/2011 | Ushiyama | B65H 1/266 399/393 |
| 2012/0061903 | A1 | 3/2012 | Eguchi et al. | |
| 2013/0250328 | A1 | 9/2013 | Ohtsuka et al. | |
| 2013/0270765 | A1 | 10/2013 | Araaki et al. | |
| 2014/0294406 | A1 | 10/2014 | Eguchi | |
| 2016/0280482 | A1 * | 9/2016 | Takai | B65H 1/266 |

FOREIGN PATENT DOCUMENTS

| | | |
|---|---|---|
| JP | 5-278871 | 10/1993 |
| JP | 2007-091365 | 4/2007 |
| JP | 2009-292581 | 12/2009 |
| JP | 2011-042491 | 3/2011 |
| JP | 2011-178508 | 9/2011 |
| JP | 2012-180169 | 9/2012 |

(Continued)

*Primary Examiner* — Patrick Cicchino
(74) *Attorney, Agent, or Firm* — Duft Bornsen & Fettig LLP

(57) ABSTRACT

A sheet feeder, which is included in an image forming apparatus, includes a pair of first regulators and a pair of second regulators. The pair of first regulators is disposed movable in a width direction of a recording medium loaded on the sheet loader and is configured to contact a side end of the recording medium and regulate a position of the recording medium in the width direction. The pair of second regulators is configured to be detachably attachable to multiple attachment positions of the sheet tray selectably.

10 Claims, 8 Drawing Sheets

(56) References Cited

FOREIGN PATENT DOCUMENTS

| | | |
|---|---|---|
| JP | 2014-162598 | 9/2014 |
| JP | 2015-129803 | 7/2015 |
| JP | 2015-168539 | 9/2015 |

* cited by examiner

SHEET LOADER AND IMAGE FORMING APPARATUS INCORPORATING THE SHEET LOADER

CROSS-REFERENCE TO RELATED APPLICATION

This patent application is based on and claims priority pursuant to 35 U.S.C. § 119(a) to Japanese Patent Application No. 2016-040113, filed on Mar. 2, 2016, in the Japan Patent Office, the entire disclosure of which is hereby incorporated by reference herein.

BACKGROUND

Technical Field

This disclosure relates to a sheet loader and an image forming apparatus that corresponds to copier, printer, facsimile machine, printing machine, and multi-functional apparatus including at least two functions of the copier, printer, facsimile machine, and printing machine.

Related Art

Sheet loaders such as sheet trays provided to an image forming apparatus are known to include a pair of regulators such as a pair of side fences. Such a pair of regulators is in contact with a side end of a recording medium to regulate a position in a width direction of the recording medium while the recording medium is loaded on a sheet loader. With the pair of regulators, the sheet loader prevents misalignment of a recording medium in an apparatus body of the image forming apparatus when the recording medium is to be loaded or when the image forming apparatus is hit by an external object.

In recent years, recording media in various paper sizes are used in printing after image formation. Consequently, recording media having various paper sizes are loaded in a sheet feeder. For example, there is a case that recording media having an SRA3 paper size that is larger than an A3 paper size are used for printing.

However, when a recording medium having such a large paper size is loaded on the sheet feeder, the above-described pair of regulators is not sufficient to align the recording medium. In this case, a position of a trailing end of the recording medium is not regulated in a width direction, and therefore misalignment of the recording medium easily occur in the sheet feeder.

In a case in which the length of the pair of regulators is sufficiently long to support the recording medium having a large paper size, the pair of regulators can regulate the position of the recording medium in the width direction. However, in this case, the long length of the pair of regulators causes deterioration in handling the recording medium.

In order to address this inconvenience, a known sheet feeder has employed a configuration in which a rib and a holding portion to regulate a trailing end and a trailing side end of a recording medium having a double letter (DLT) paper size in a housing of a sheet tray, separate from a side fence or side fences.

SUMMARY

At least one aspect of this disclosure provides a sheet loader including a pair of first regulators and a pair of second regulators. The pair of first regulators is disposed movable in a width direction of a recording medium loaded on the sheet loader and is configured to contact a side end of the recording medium and regulate a position of the recording medium in the width direction. The pair of second regulators is configured to be detachably attachable to multiple attachment positions of the sheet tray selectably.

Further, at least one aspect of this disclosure provides an image forming apparatus including the above-described loader and an image forming device configured to form an image on the recording medium fed from the sheet loader.

DETAILED DESCRIPTION

Figure 1:
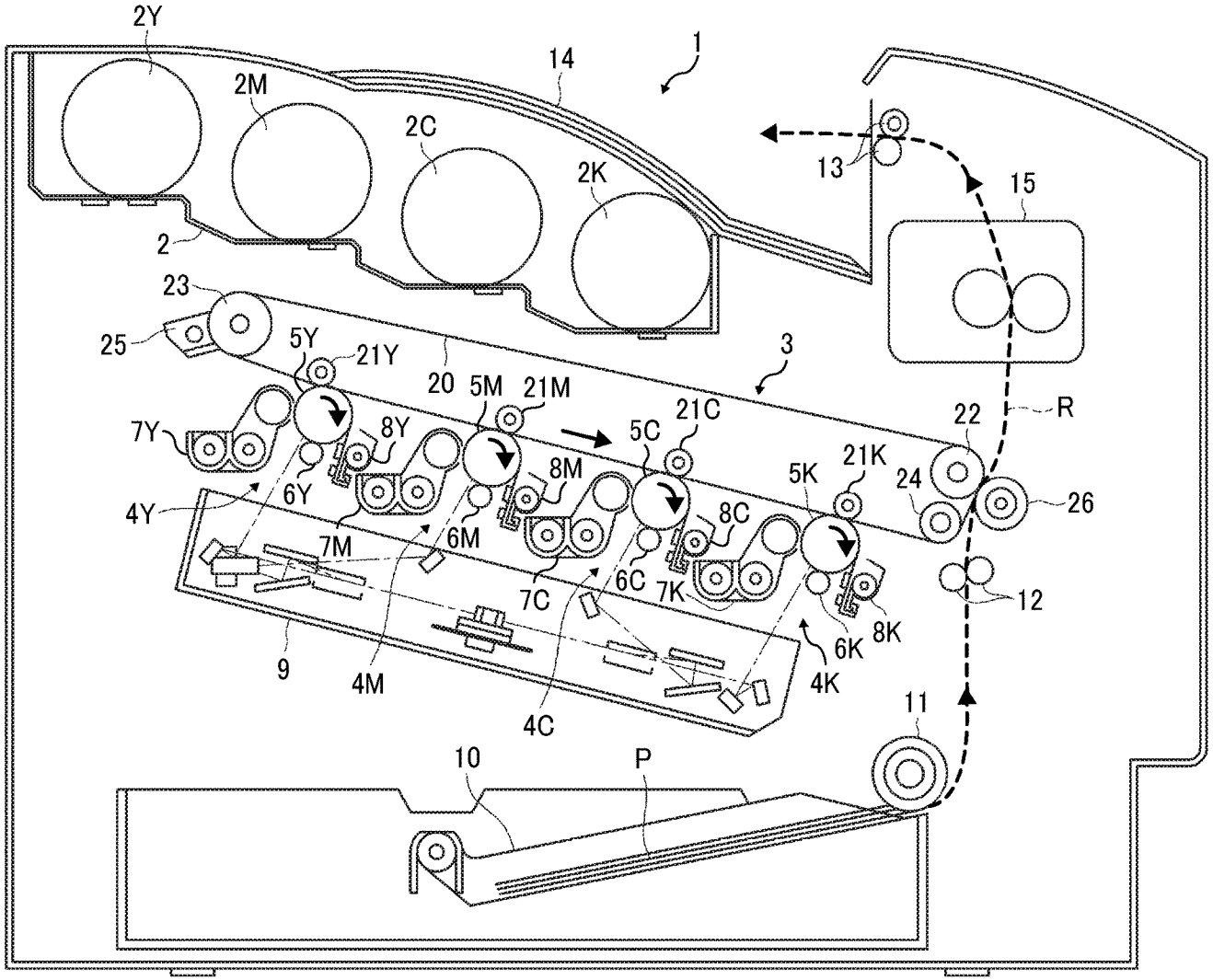
FIG. 1 is a vertical sectional view illustrating a schematic configuration of an image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

FIG. 1 is a schematic vertical sectional view of the image forming apparatus 1 according to the present embodiment of this disclosure.

It is to be noted that identical parts are given identical reference numerals and redundant descriptions are summarized or omitted accordingly.

The image forming apparatus 1 may be a copier, a facsimile machine, a printer, a multifunction peripheral or a multifunction printer (MFP) having at least one of copying, printing, scanning, facsimile, and plotter functions, or the like. According to the present example, the image forming apparatus 1 is an electrophotographic copier that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

Now, a description is given of an entire configuration and functions of the image forming apparatus 1 according to an embodiment of this disclosure.

As illustrated in FIG. 1, the image forming apparatus 1 includes four image forming devices 4Y, 4M, 4C, and 4K disposed at a center portion thereof. The image forming devices 4Y, 4M, 4C, and 4K have substantially the same configuration except for containing different color developers (e.g., toners) of yellow (Y), magenta (M), cyan (C), and black (K) corresponding to color separation components of a color image.

Specifically, each of the image forming devices 4Y, 4M, 4C, and 4K includes a drum-shaped photoconductor 5 (i.e., drum-shaped photoconductors 5Y, 5M, 5C, and 5K), a charging device 6 (i.e., charging devices 6Y, 6M, 6C, and 6K), a developing device 7 (i.e., developing devices 7Y, 7M, 7C, and 7K), and a cleaning device 8 (i.e., cleaning devices 8Y, 8M, 8C, and 8K).

The drum-shaped photoconductor 5 (the drum-shaped photoconductors 5Y, 5M, 5C, and 5K) functions as an image bearer that bears an electrostatic latent image and resultant toner image.

The charging device 6 (the charging devices 6Y, 6M, 6C, and 6K) uniformly charges an outer circumferential surface of the photoconductor 5.

The developing device 7 (the developing devices 7Y, 7M, 7C, and 7K) supplies toner to the electrostatic latent image formed on the outer circumferential surface of the photoconductor 5, thus developing (visualizing) the electrostatic latent image as a toner image.

The cleaning device 8 (the cleaning devices 8Y, 8M, 8C, and 8K) cleans the outer circumferential surface of the photoconductor 5.

An exposure device 9 is disposed below the image forming devices 4Y, 4M, 4C, and 4K. The exposure device 9 exposes the outer circumferential surface of the respective photoconductors 5 with laser light beams. The exposure device 9 includes a light source, a polygon mirror, an f-O lens, and reflection mirrors, and emits a laser light beam onto the outer circumferential surface of the respective photoconductors 5 according to image data sent transmitted from an external device such as a client computer.

A transfer device 3 is disposed above the image forming devices 4Y, 4M, 4C, and 4K. For example, the transfer device 3 includes an intermediate transfer belt 20 functioning as an intermediate transfer body, four primary transfer rollers 21Y, 21M, 21C, and 21K functioning as primary transfer bodies, a secondary transfer roller 26 functioning as a secondary transfer body, a secondary transfer backup roller 22, a cleaning backup roller 23, a tension roller 24, and a belt cleaning device 25.

The intermediate transfer belt 20 is an endless belt stretched across the secondary transfer backup roller 22, the cleaning backup roller 23, and the tension roller 24. As a driver drives and rotates the secondary transfer backup roller 22, the secondary transfer backup roller 22 moves (rotates) the intermediate transfer belt 20 circling in a direction indicated by arrow in FIG. 1.

The four primary transfer rollers 21Y, 21M, 21C, and 21K hold the intermediate transfer belt 20 together with the four photoconductors 5, respectively, forming four primary transfer nip regions between the intermediate transfer belt 20 and the photoconductors 5. The primary transfer rollers 21Y, 21M, 21C, and 21K are connected to a power supply that applies a predetermined direct current (DC) voltage and/or alternating current (AC) voltage to the primary transfer rollers 21Y, 21M, 21C, and 21K.

The secondary transfer roller 26 holds the intermediate transfer belt 20 together with the secondary transfer backup roller 22, forming a secondary transfer nip region between the secondary transfer roller 26 and the intermediate transfer belt 20. Similar to the primary transfer rollers 21Y, 21M, 21C, and 21K, the secondary transfer roller 26 is connected to the power supply that applies a predetermined direct current (DC) voltage and/or alternating current (AC) voltage thereto.

The belt cleaning device 25 includes a cleaning brush and a cleaning blade, both of which contact an outer circumferential surface of the intermediate transfer belt 20. A waste toner conveyance tube extending from the belt cleaning device 25 to an inlet of a waste toner container conveys waste toner collected from the intermediate transfer belt 20 by the belt cleaning device 25 to the waste toner container.

A bottle holder 2 is disposed in an upper portion of the image forming apparatus 1 and accommodates four toner bottles 2Y, 2M, 2C, and 2K detachably attached to the image forming apparatus 1 to contain and supply fresh yellow, magenta, cyan, and black toners to the developing devices 7Y, 7M, 7C, and 7K of the image forming devices 4Y, 4M, 4C, and 4K, respectively. For example, the fresh yellow, magenta, cyan, and black toners are supplied from the toner bottles 2Y, 2M, 2C, and 2K to the developing devices 7 through toner supply tubes interposed between the toner bottles 2Y, 2M, 2C, and 2K and the developing devices 7Y, 7M, 7C, and 7K, respectively.

The image forming apparatus 1 further includes a sheet tray 10 and a feed roller 11 disposed in a lower portion of the image forming apparatus 1. The sheet tray 10 that functions as a sheet loader loads recording media P (e.g., sheets). The feed roller 11 picks up and feeds a recording medium P from the sheet tray 10 toward the secondary transfer nip region formed between the secondary transfer roller 26 and the intermediate transfer belt 20. The recording media P may be thick paper, postcards, envelopes, plain paper, thin paper, coated paper, art paper, tracing paper, OHP (overhead projector) transparencies, OHP film sheets, and the like. Additionally, a bypass tray that loads postcards, envelopes, OHP transparencies, OHP film sheets, and the like may be attached to the image forming apparatus 1.

A conveyance passage R extends from the feed roller 11 to a pair of output rollers 13 to convey the recording medium P picked up from the sheet tray 10 onto an outside of the image forming apparatus 1 through the secondary transfer nip region. The conveyance passage R is provided with a pair of registration rollers 12 located below the secondary transfer nip region formed between the secondary transfer roller 26 and the intermediate transfer belt 20, that is, upstream from the secondary transfer nip region in a recording medium conveyance direction. The pair of registration rollers 12 functioning as a pair of timing rollers feeds the recording medium P conveyed from the feed roller 11 toward the secondary transfer nip region.

The conveyance passage R is further provided with a fixing device 15 located above the secondary transfer nip region, that is, downstream from the secondary transfer roller 26 in the secondary transfer nip region in the recording medium conveyance direction. The fixing device 15 fixes an unfixed toner image transferred from the intermediate transfer belt 20 onto the recording medium P conveyed from the secondary transfer nip region. The conveyance passage R is further provided with the pair of output rollers 13 located above the fixing device 15, that is, downstream from the fixing device 15 in the recording medium conveyance direction. The pair of output rollers 13 discharges the recording medium P bearing the fixed toner image onto the outside of the image forming apparatus 1, that is, onto an output tray 14 disposed atop the image forming apparatus 1. The output tray 14 stocks the recording medium P discharged by the pair of output rollers 13.

With reference to FIG. 1, a description is given of an image forming operation of the image forming apparatus 1 having the structure described above to form a color toner image on a recording medium P.

As a print job starts, a driver drives and rotates the photoconductors 5 of the image forming devices 4Y, 4M, 4C, and 4K, respectively, in a clockwise direction in FIG. 1. The charging devices 6 uniformly charge the outer circumferential surface of the respective photoconductors 5Y, 5M, 5C, and 5K at a predetermined polarity. The exposure device 9 emits laser light beams onto the charged outer circumferential surface of the respective photoconductors 5Y, 5M, 5C, and 5K according to yellow, magenta, cyan, and black image data contained in image data sent from the external device, respectively, thus forming electrostatic latent images thereon. It is to be noted that the image data to be exposed to the respective photoconductors 5Y, 5M, 5C, and 5K is a single color image data of each color separated into each color information of yellow, magenta, cyan, and black. The developing devices 7Y, 7M, 7C, and 7K supply yellow, magenta, cyan, and black toners to the electrostatic latent images formed on the photoconductors 5Y, 5M, 5C, and 5K, developing (visualizing) the electrostatic latent images into yellow, magenta, cyan, and black toner images, respectively.

Simultaneously, as the print job starts, the secondary transfer backup roller 22 is driven and rotated in a counterclockwise direction in FIG. 1, circulating the intermediate transfer belt 20 in a direction indicated by arrow in FIG. 1. The power supply applies a constant voltage or a constant current control voltage having a polarity opposite a polarity of the toner to the primary transfer rollers 21, creating a transfer electric field at each primary transfer nip region formed between the photoconductor 5 and the primary transfer roller 21.

Thereafter, when the yellow, magenta, cyan, and black toner images formed on the photoconductors 5Y, 5M, 5C, and 5K reach the primary transfer nip regions, respectively, in accordance with rotation of the photoconductors 5Y, 5M, 5C, and 5K, the yellow, magenta, cyan, and black toner images are primarily transferred from the photoconductors 5Y, 5M, 5C, and 5K onto the intermediate transfer belt 20 by the transfer electric field created at the primary transfer nip regions such that the yellow, magenta, cyan, and black toner images are superimposed successively on a same position on the intermediate transfer belt 20. Thus, a color toner image is formed on the surface of the intermediate transfer belt 20. After the primary transfer of the yellow, magenta, cyan, and black toner images are transferred from the photoconductors 5Y, 5M, 5C, and 5K onto the intermediate transfer belt 20, the cleaning devices 8Y, 8M, 8C, and 8K remove residual toner that is failed to be transferred onto the intermediate transfer belt 20 and therefore remains on the photoconductors 5Y, 5M, 5C, and 5K from the outer circumferential surface of the respective photoconductors 5Y, 5M, 5C, and 5K. Thereafter, electrical discharging devices discharge the outer circumferential surface of the respective photoconductors 5Y, 5M, 5C, and 5K, initializing the surface potential of the respective photoconductors 5Y, 5M, 5C, and 5K.

By contrast, the feed roller 11 that is disposed in the lower portion of the image forming apparatus 1 is driven and rotated to feed a recording medium P from the sheet tray 10 toward the pair of registration rollers 12 in the conveyance passage R. As the recording medium P comes into contact with the pair of registration rollers 12, the pair of registration rollers 12 interrupts its rotation and temporarily halts the recording medium P.

Thereafter, the pair of registration rollers 12 resumes its rotation and conveys the recording medium P to the secondary transfer nip region at a time when the color toner image formed on the intermediate transfer belt 20 reaches the secondary transfer nip region. At this time, the secondary transfer roller 26 is applied with a transfer voltage having a polarity opposite a polarity of the charged yellow, magenta, cyan, and black toners constituting the color toner image formed on the intermediate transfer belt 20, thus creating a transfer electric field at the secondary transfer nip region. The transfer electric field secondarily transfers the yellow, magenta, cyan, and black toner images constituting the color toner image formed on the intermediate transfer belt 20 onto the recording medium P collectively. After the secondary transfer of the color toner image from the intermediate transfer belt 20 onto the recording medium P, the belt cleaning device 25 removes residual toner, which is failed to be transferred onto the recording medium P and therefore remains on the intermediate transfer belt 20, from the outer circumferential surface of the intermediate transfer belt 20. The removed toner is conveyed and collected into the waste toner container.

Thereafter, the recording medium P bearing the color toner image is conveyed to the fixing device 15 that fixes the color toner image on the recording medium P. Then, the recording medium P bearing the fixed color toner image is discharged by the pair of output rollers 13 onto the output tray 14.

The above description is given to describe the image forming operation of the image forming apparatus 1 to form the color toner image on the recording medium P. Alternatively, the image forming apparatus 1 may form a monochrome toner image by using any one of the four image forming devices 4Y, 4M, 4C, and 4K or may form a bicolor or tricolor toner image by using two or three of the image forming devices 4Y, 4M, 4C, and 4K.

The image forming apparatus 1 described above performs image formation to be printed on recording media P having various paper sizes, for example, B4, A3, DLT (double letter), and SRA3 (supplementary raw format A3) paper sizes. Consequently, the recording media P having the above-described various paper sizes are loaded on the sheet tray 10 at respective predetermined positions appropriately.

The following description is given to explain the configuration of the sheet tray 10 that functions as a sheet loader according to the present embodiment of this disclosure.

Figure 2:
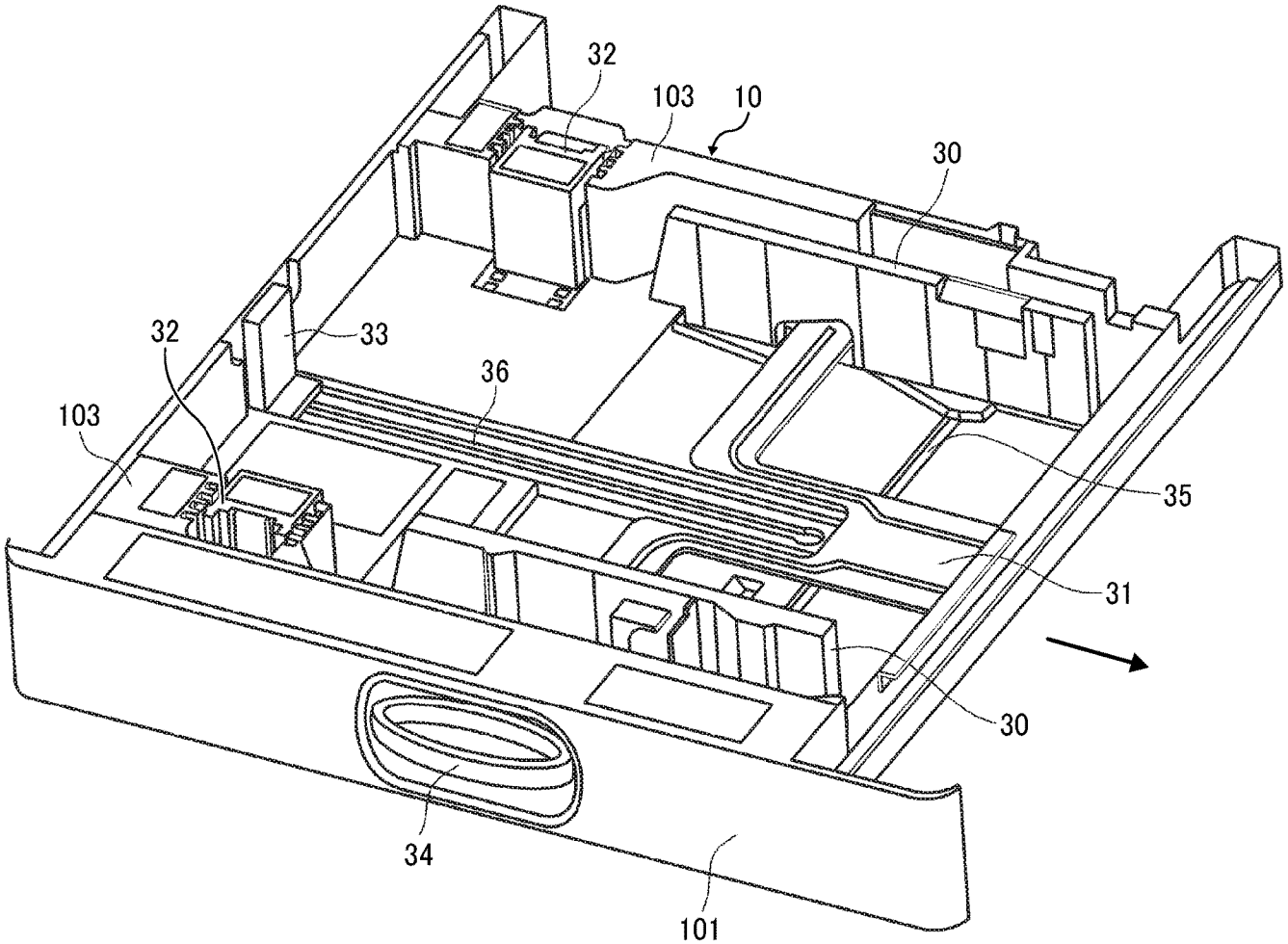
FIG. 2 is a perspective view illustrating a sheet tray according to an embodiment of this disclosure.

As illustrated in FIG. 2, the sheet tray 10 includes a pair of side fences 30 that functions as a pair of first regulators, a push-up plate 31 disposed between the pair of side fences 30, a pair of second regulators 32, and a trailing end regulating plate 33.

The sheet tray 10 further includes a front panel 101 that is part of an exterior face of the image forming apparatus 1. The front panel 101 is provided with a handle 34. By holding the handle 34 to manually operate the sheet tray 10, the sheet tray 10 is detached from or attached to an apparatus body of the image forming apparatus 1.

The pair of side fences 30 is disposed at a downstream side (a leading end side) of the recording medium P in a sheet conveying direction of the recording medium P. Hereinafter, the sheet conveying direction of the recording medium P is also referred to simply as the sheet conveying direction. The pair of second regulators 32 is disposed at an upstream side of the recording medium P in the sheet conveying direction. The feed roller 11 is disposed at the downstream side of the sheet tray 10 in the sheet conveying direction and above the sheet tray 10 to convey the recording medium P to the downstream side in the sheet conveying direction.

The recording medium P to be loaded on the sheet tray 10 is placed between the pair of side fences 30, at a predetermined position at the downstream side in the sheet conveying direction as a reference position. As the pair of side fences 30 moves toward the recording medium P, the pair of side fences 30 contacts both side ends of the recording medium P. By so doing, the position of the recording medium P in the width direction is regulated.

The pair of side fences 30 moves in the width direction of the loaded recording medium P on a rail 35. As the pair of side fences 30 moves, an interval between the pair of side fences 30 is adjusted to correspond to the width of the recording medium P, and therefore the pair of side fences 30 contacts the side ends of the recording medium P.

The push-up plate 31 is disposed between the pair of side fences 30. A bundle of recording media P is loaded on the push-up plate 31 of the sheet tray 10. The push-up plate 31 is movable in upward and downward directions (e.g., in a vertical direction). As the push-up plate 31 moves upward, the bundle of recording media P loaded on the push-up plate 31 is pushed upward to the feed roller 11, so that an uppermost recording medium P placed on the bundle of recording media P can be fed to the downstream side in the sheet conveying direction by the feed roller 11.

The trailing end regulating plate 33 contacts the trailing end of the recording medium P. The trailing end regulating plate 33 moves in the sheet conveying direction of the loaded recording medium P on a rail 36. The trailing end regulating plate 33 adjusts the position of the trailing end regulating plate 33 according to the length of the loaded recording medium P so as to contact the trailing end of the recording medium P.

Figure 3:
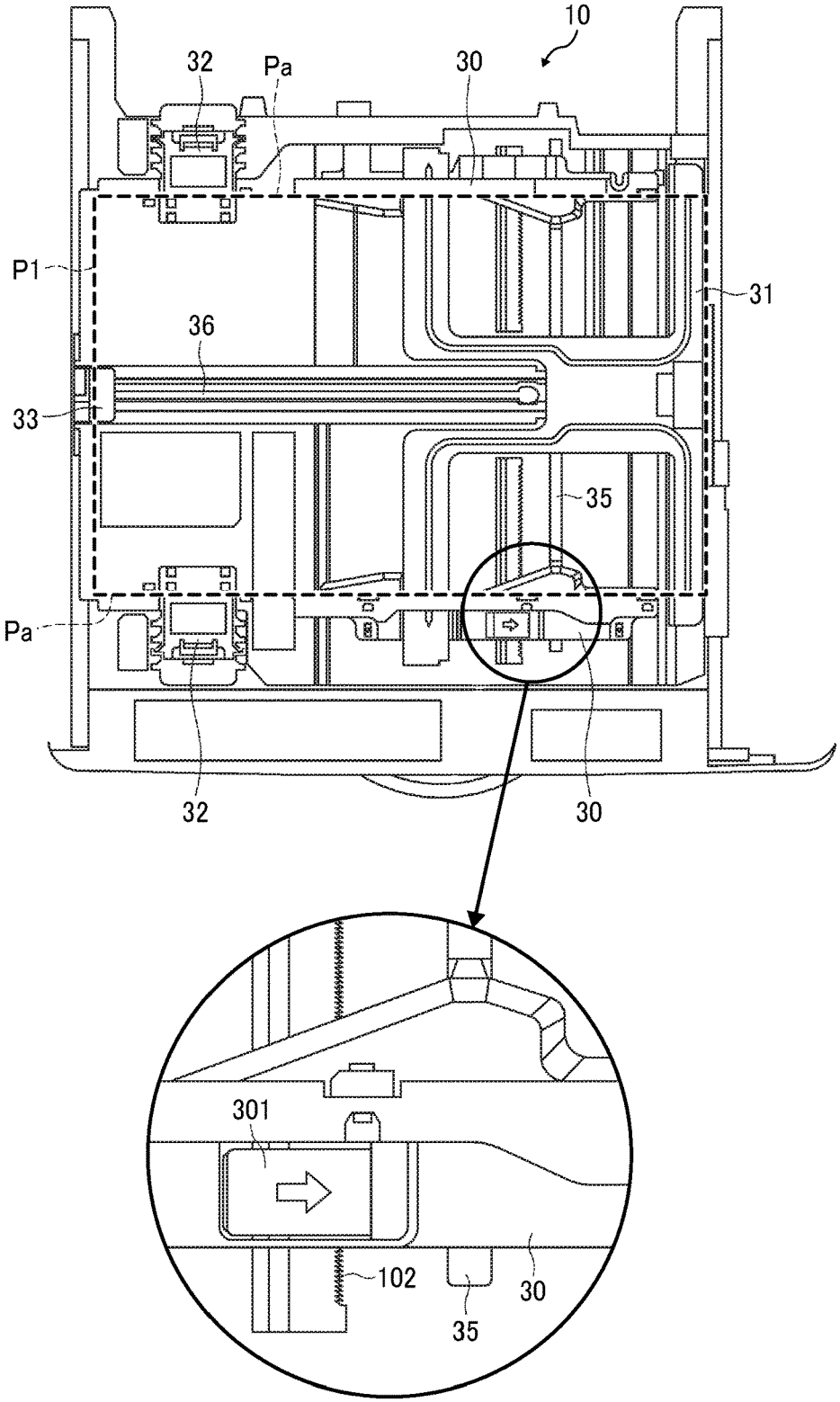
FIG. 3 is a plan view illustrating the sheet tray of FIG. 2.

In a case in which a recording medium to be loaded on the sheet tray 10 is a recording medium P1 having a large paper size as illustrated with a dotted line in FIG. 3, a length of the recording medium P1 in the sheet conveying direction exceeds the length of each of the pair of side fences 30. Therefore, a side end Pa near the trailing end of the recording medium P1 is not regulated by the pair of side fences 30. As a result, the trailing end of the recording medium P1 is misaligned inside the sheet tray 10. In other words, the trailing end of the recording medium P1 is not regulated and becomes loose.

By contrast, the pair of side fences 30 may be provided with a sufficiently long length to regulate the length of the large recording medium P1. However, in this case, the long length of the pair of side fences 30 causes deterioration in handling the recording media.

As illustrated in the enlarged view of FIG. 3, the pair of side fences 30 is provided with a locking member 301 to fix a position of the pair of side fences 30. The locking member 301 has an image of arrow illustrated on a surface thereof. As the locking member 301 moves in a direction indicated by the arrow on the surface, a projection that is provided on a bottom side of the locking member 301 is fitted to a fitting portion 102 provided on the sheet tray 10. Accordingly, the position of the pair of side fences 30 in the sheet tray 10 is fixed.

As described above in the present embodiment, in a case in which the pair of side fences 30 is fixedly located at a side near the leading end of the recording medium P, an effect of regulation given by the pair of side fences 30 to the position of the recording medium P in the width direction is less or smaller at the trailing end that is far from the fixed position of the pair of side fences 30 (i.e., the position near the leading end of the recording medium P). Therefore, in a case in which a recording medium P having a large paper size exceeding the length of the pair of side fences 30 is loaded on the sheet tray 10, misalignment of the recording medium P occurs more at the trailing end as the paper size of the recording medium P becomes greater, and the above-described inconvenience becomes remarkable.

In order to address the above-described inconvenience, the sheet tray 10 according to the present embodiment includes the pair of second regulators 32 near the trailing end of the recording medium P. The pair of second regulators 32 is detachably attachable to the sheet tray 10. The pair of second regulators 32 regulates the position of the side end Pa at the trailing end of the recording medium P. Therefore, even when the large recording medium P1 is loaded on the sheet tray 10, misalignment of the recording medium P1 is less generated while being loaded on the sheet tray 10. In the present embodiment, the pair of side fences 30 is a main regulator pair to regulate the position in the width direction at the leading end of a recording medium P. That is, the pair of second regulators 32 is a sub regulator pair to regulate the position in the width direction at the trailing end of a recording medium P, especially the trailing end of a large recording medium P.

Figure 4A:
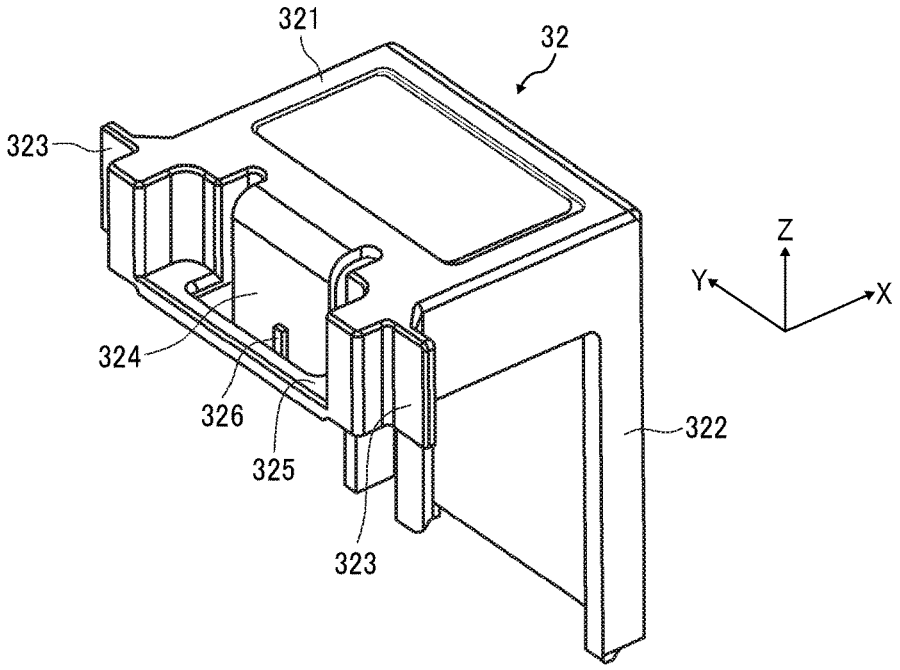
FIG. 4A is a perspective view illustrating a second regulator according to an embodiment of this disclosure.
Figure 4B:
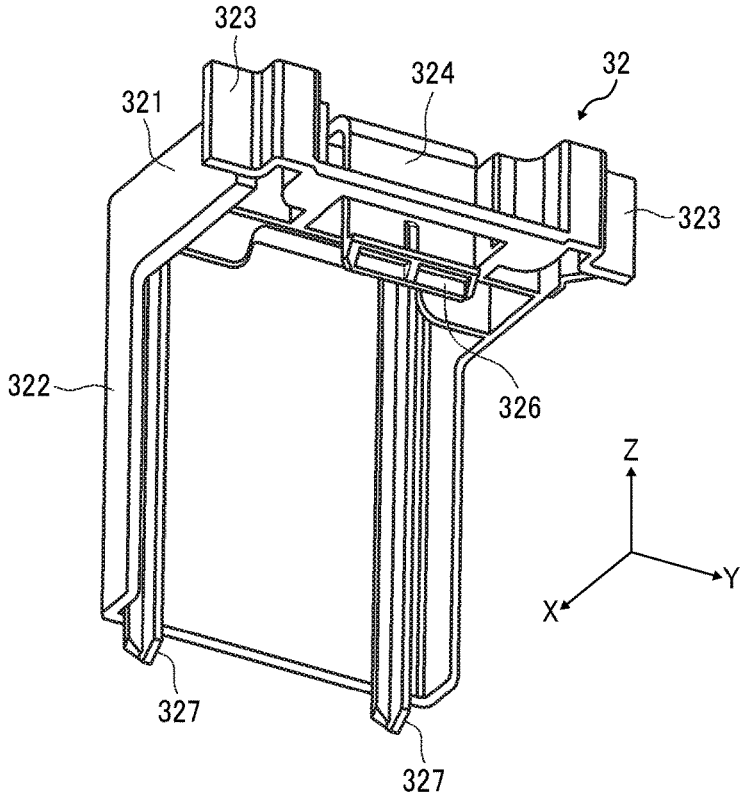
FIG. 4B is another perspective view illustrating the second regulator of FIG. 4A.

Now, a detailed description is given of the pair of second regulators 32, with reference to FIGS. 4A and 4B.

FIG. 4A is a perspective view illustrating one of the pair of second regulators 32 according to an embodiment of this disclosure. FIG. 4B is another perspective view illustrating the one of the pair of second regulators 32 of FIG. 4A. In FIGS. 4A and 4B, an X-axis direction indicates a forward and backward direction (i.e., a direction of arrow is a backward direction and a direction opposite the arrow is a forward direction), a Y-axis direction indicates a left and right direction (i.e., a horizontal direction), and a Z-axis direction indicates an upward and downward direction (i.e., a vertical direction). However, the X-axis direction, the Y-axis direction, and the Z-axis direction are examples, and therefore these directions are not limited to indicate certain directions when the members and units used in the image forming apparatus 1 according to the present embodiment are disposed or assembled.

It is to be noted that the one of the pair of second regulators 32 is occasionally referred to as the "second regulator 32", for convenience. The configurations of the pair of second regulators 32 are basically identical to each other and the shapes of the pair of second regulators 32 are laterally symmetrical.

As illustrated in FIG. 4A, the second regulator 32 an L-shaped member having a horizontal portion 321 and a vertical portion 322. The horizontal portion 321 of the second regulator 32 extends in the forward and backward direction. The vertical portion 322 of the second regulator 32 extends in a downward direction from a rear side of the horizontal portion 321.

First locking portions 323 are disposed at both lateral (left and right) ends on the front side of the horizontal portion 321 of the second regulator 32. Both of the first locking portions 323 respectively project toward the left and right directions. Each of the first locking portions 323 is fitted into a locking hole formed on the sheet tray 10.

A claw 324 is provided on the front side of the horizontal portion 321, extending downwardly from an upper side end face of the horizontal portion 321.

A step 325 is provided on the front side of the claw 324, at a position one step lower than the upper side end face of the horizontal portion 321.

As illustrated in FIG. 4B, the claw 324 has an engaging claw portion 326 at a lower end thereof. The engaging claw portion 326 is fitted to the sheet tray 10.

Second locking portions 327 that function as locking portions are disposed at both lateral (left and right) ends on the lower side of the vertical portion 322, extending further downwardly from a lower face of the vertical portion 322.

The pair of second regulators 32 is detachably attached to the sheet tray 10. FIG. 2 illustrates a state in which the pair of second regulators 32 are attached to both side walls 103 of the sheet tray 10. Each of the side walls 103 has attachment positions at which each of the pair of second regulators 32 is selectably attached to the corresponding one of the side walls 103.

Figure 5A:
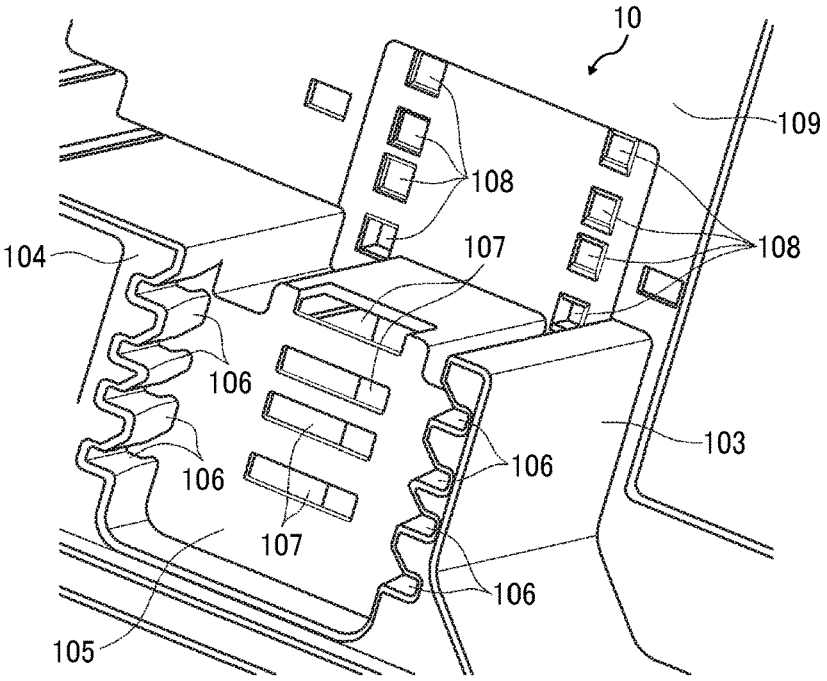
FIG. 5A is a perspective view illustrating attachment positions at which the second regulator is selectably attached to the sheet tray.
Figure 5B:
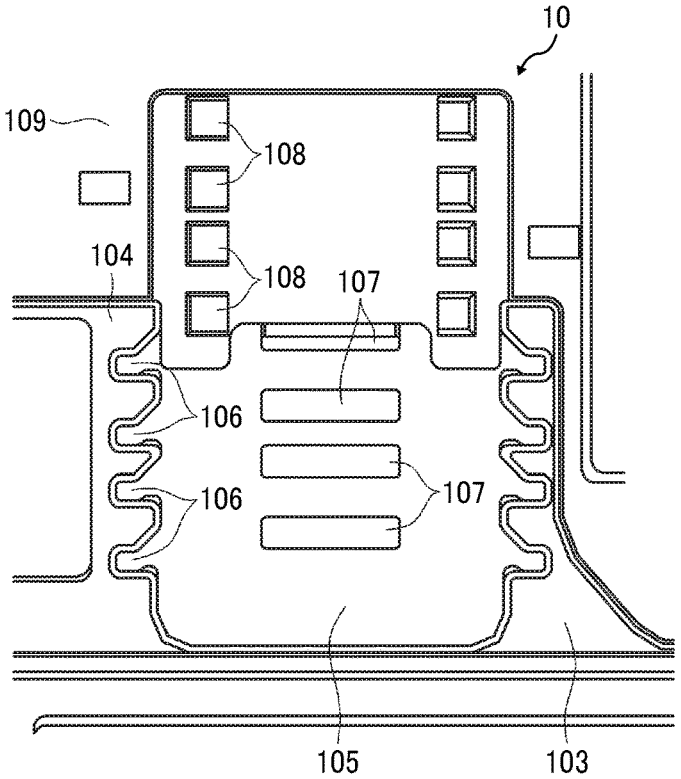
FIG. 5B is a plan view illustrating the attachment positions at which the second regulator is selectably attached to the sheet tray.

FIG. 5A is a perspective view illustrating the attachment positions at which the second regulator 32 is selectably attached to the sheet tray 10. FIG. 5B is a plan view illustrating the attachment positions at which the second regulator 32 is selectably attached to the sheet tray 10.

As illustrated in FIGS. 5A and 5B, a step 105 is provided at a position one step lower than an upper side end face 104 of the side walls 103. In a state in which the second regulator 32 is attached to the sheet tray 10, the horizontal portion 321 (FIGS. 4A and 4B) of the second regulator 32 is placed at the position of the step 105.

As illustrated in FIGS. 5A and 5B, multiple first locking recesses 106 are provided at both sides of the step 105 to lock the first locking portions 323 of the second regulator 32. For example, four first locking recesses 106 are formed on each side of the step 105 in FIGS. 5A and 5B. Further, the step 105 includes four fitting openings 107, for example. The engaging claw portion 326 of the claw 324 of the second regulator 32 is fitted to a selected one of the fitting openings 107.

Four second locking holes 108 are provided to each lateral side (i.e., each of the left and right sides) of a bottom plate 109 of the sheet tray 10. Each of the second locking portions 327 of the second regulator 327 is locked with a selected one of the four second locking holes 108.

Figure 6:
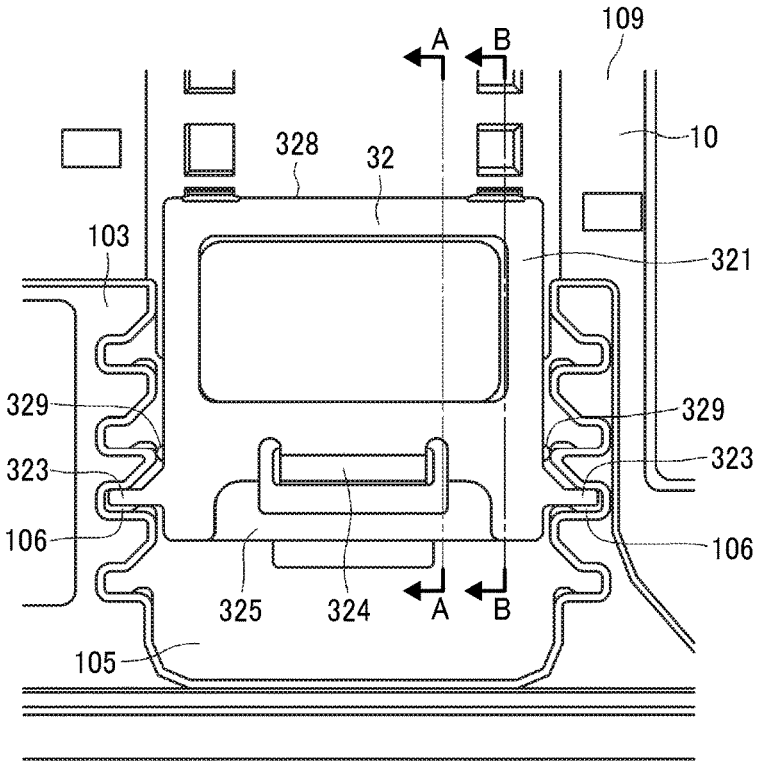
FIG. 6 is a plan view illustrating an attachment state of the second regulator attached to the sheet tray.
Figure 7:
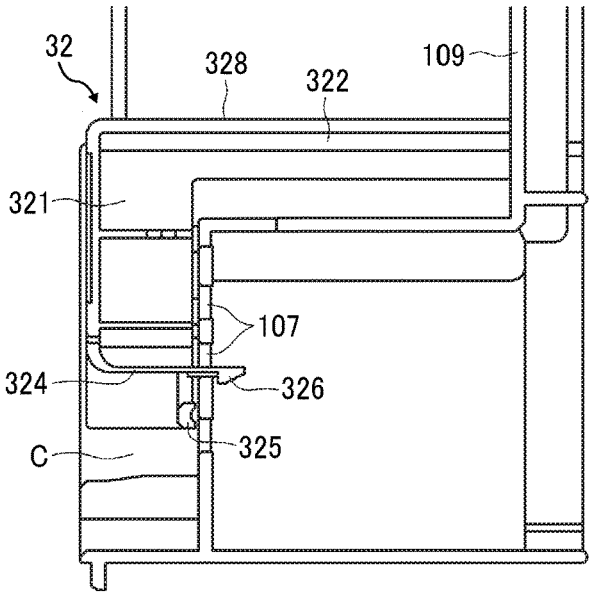
FIG. 7 is a cross sectional view illustrating the sheet regulator of FIG. 6, along a line A-A.
Figure 8:
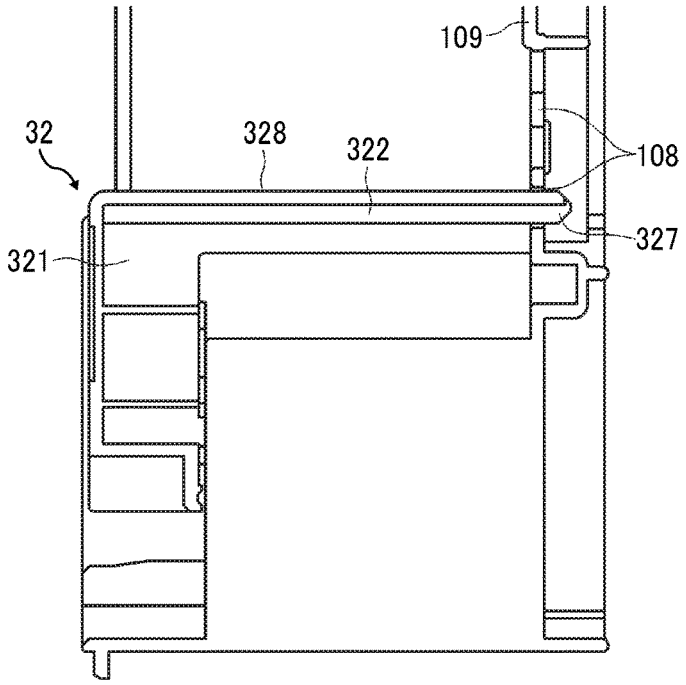
FIG. 8 is a cross sectional view illustrating the sheet regulator of FIG. 6, along a line B-B.

FIG. 6 is a plan view illustrating an attachment state of the second regulator 32 attached to the side wall 103 of the sheet tray 10. FIG. 7 is a cross sectional view illustrating the sheet regulator 32 of FIG. 6, along a line A-A. FIG. 8 is a cross sectional view illustrating the sheet regulator 32 of FIG. 6, along a line B-B.

In a state in which the second regulator 32 is attached to the sheet tray 10, the respective one of the pair of first locking portions 323 is inserted into the corresponding one of the first locking recesses 106, as illustrated in FIG. 6, and the horizontal portion 321 of the second regulator 32 is placed at the step 105. Further, as illustrated in FIG. 7, the engaging claw portion 326 provided to the horizontal portion 321 is fitted to a selected one of the fitting openings 107, so that the second regulator 32 cannot be detached from the sheet tray 10. Further, as illustrated in FIG. 8, the vertical portion 322 of the second regulator 32 extends toward the bottom plate 109 of the sheet tray 10, so that the second locking portion 327 is insert into a selected one of the four second locking holes 108.

Projections 329 are provided at both ends in the width direction of the second regulator 32. The projections 329 contact the side wall 103 of the sheet tray 10, thereby preventing the second regulator 32 from wobbling in the width direction.

A contact face 328 provided to the vertical portion 322 is a face that contacts the side end of the recording medium P. As the pair of side fences 30 moves toward the contact face 328, the pair of side fences 30 contacts both side ends of the recording medium P. By so doing, the position of the recording medium P in the width direction is regulated.

Both the first locking portions 323 and the second locking portions 327, which are provided on both sides in the width direction of the second regulator 32 (i.e., the left and right direction in FIG. 6), are inserted into the first locking recess 106 and the second locking hole 108 of the sheet tray 10, respectively. By so doing, the positional relation of the second regulator 32 to the sheet tray 10 is fixed, and therefore the second regulator 32 can be prevented from wobbling in the vertical (upward and downward) direction and the horizontal (left and right) direction in FIG. 6. Accordingly, the contact face 328 confronts and contacts the side end of the recording medium P, so that the second regulator 32 can regulate the position of the recording medium P in the width direction with accuracy.

As illustrated in FIG. 7, the claw 324 is disposed to be operable in a state in which the second regulator 32 is attached to the sheet tray 10. That is, the step 325 is provided to the second regulator 32 and the step 105 is provided to the sheet tray 10. In this configuration, a space C is provided on the front side of the claw 324. A user can insert the finger from the space C to operate (press) the engaging claw portion 326, so that the engaging claw portion 326 can be released from a fitting state with the fitting opening 107. Therefore, the second regulator 32 can be detached from the sheet tray 10 without taking complicated procedures.

Both of the pair of second regulators 32 have bilaterally symmetrical shapes and use the same parts and components on both sides. Accordingly, this configuration can reduce the number of parts and components, and therefore can achieve a reduction in cost.

As illustrated in FIGS. 5A and 5B, the sheet tray 10 has four pairs of the first locking recesses 106, four fitting openings 107, and four pairs of second locking holes 108, respectively aligned in the width direction of the recording medium P to be loaded. That is, there are four selectable attachment positions for the second regulator 32 to be attached to the sheet tray 10. Specifically, one of the four selectable attachment positions for the second regulator 32 to be attached to the sheet tray 10 is determined depending on which locking recess, locking hole, or fitting opening of the sheet tray 10 is locked or engaged with the locking portion or the claw of the second regulator 32.

Figure 9:
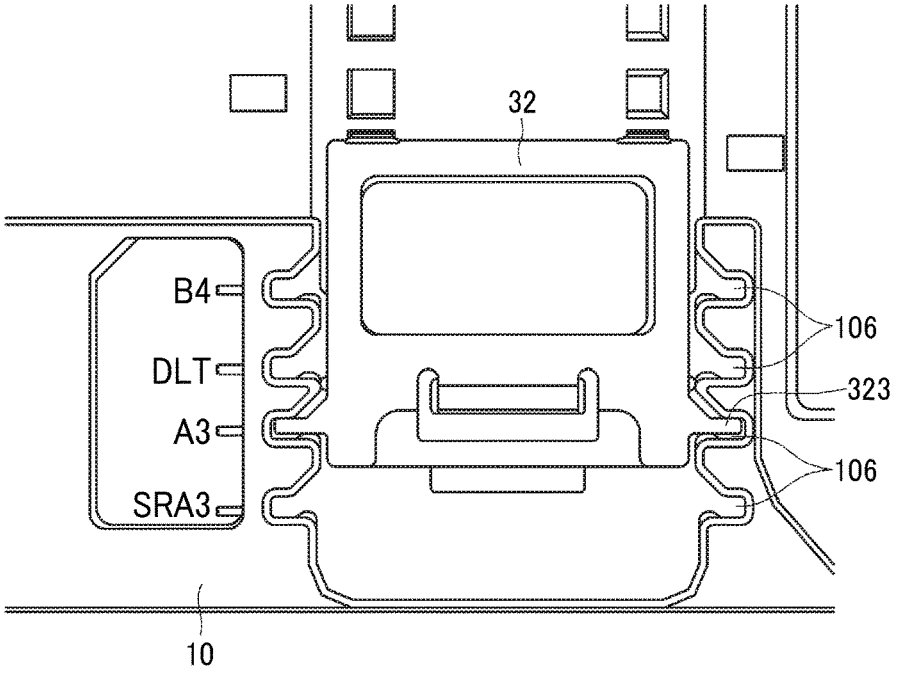
FIG. 9 is a plan view illustrating a relation of the second regulator and various sheet sizes.

Respective positions of the pair of second regulators 32 correspond to the width of the recording medium P to be loaded on the sheet tray 10. For example, FIG. 9 is a plan view illustrating a relation of the second regulator 32 and various sheet sizes. As illustrated in FIG. 9, the names indicating respective paper sizes, which are B4, DLT, A3, and SRA3 paper sizes in this order from the top, are provided on the surface of the sheet tray 10. Depending on the position to which the second regulator 32 is fitted, the width of the recording medium P corresponds to any of the widths of B4, DLT, A3, and SRA3 size recording media. For example, in a case in which the second regulator 32 is attached to the sheet tray 10 at the position at which the first locking portion 323 of the second regulator 32 is inserted into the uppermost one of the first locking recesses 106, the interval of the pair of second regulators 32 is set to correspond to the width of the recording medium P having a B4 paper size. Therefore, each contact face 328 of the pair of second regulators 32 can be brought into contact with both side ends of the B4-size recording medium P.

As described above, the sheet tray 10 has multiple attachment positions to which the second regulator 32 is attached, and therefore the position of the second regulator 32 can be changed according to the width of the recording medium P to be loaded on the sheet tray 10. Accordingly, the pair of second regulators 32 can contact the side ends of recording media P of various paper sizes, so that the position of various recording media P in the width direction can be regulated.

It is to be noted that the second regulator 32 according to the present embodiment is provided to regulate the position near the trailing end in the width direction of a large-size recording medium mainly. Therefore, the position near the trailing end in the width direction of a B4-size recording medium or larger can be regulated. At this time, the positions of the first locking recesses 106, the fitting openings 107, and the second locking holes 108 can be changed to be applied to recording media having any paper size other than the above-described B4, DLT, A3, and SRA3 paper sizes. Further, recording media having a paper size smaller than the B4-size recording medium can also be applied to this disclosure. In addition, types of recording media to which the second regulator 32 is applicable to regulate can be adjusted by changing the number of locking recesses or holes of the sheet tray 10. That is, the numbers of the locking recesses 106, the fitting openings 107, and the second locking holes 108 are not limited to four but any other number can be applicable to this disclosure.

Figure 10:
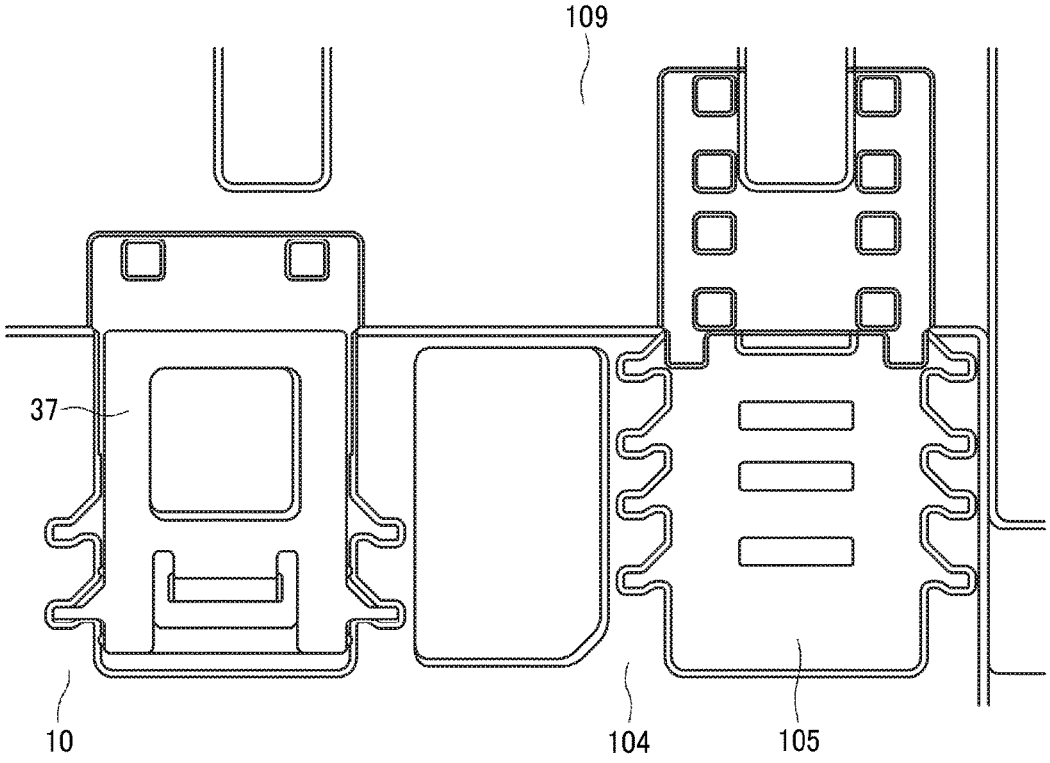
FIG. 10 is a plan view illustrating a third regulator.

Further, multiple pairs of regulators may be detachably attached to the sheet tray 10 in the sheet conveying direction. For example, FIG. 10 is a plan view illustrating a pair of third regulators 37. As illustrated in FIG. 10, the pair of third regulators 37 is disposed closer to the trailing end of the recording medium P than the second regulator 32, at both ends of the recording medium P in the width direction. Accordingly, the position of the recording medium P in the width direction can be regulated. In this case, the pair of third regulators 37 corresponds to recording media having a larger paper size. When compared with the pair of second regulator 32, the pair of third regulators 37 handles the smaller number of applicable types of recording media, and therefore the sheet tray 10 illustrated in FIG. 10 includes two locking recesses and two fitting openings. However, both the number of locking recesses and the number of fitting openings are not limited to two but any other number can be applicable to this disclosure.

In the above-described embodiments, the pair of side fences 30 is disposed close to the leading end of the recording medium P and the pair of second regulators 32 is disposed close to the trailing end of the recording medium P. However, the configuration of the sheet tray 10 applicable to this disclosure is not limited thereto. For example, the pair of side fences 30 may be disposed close to the trailing end of the recording medium P and the pair of second regulators 32 may be disposed close to the leading end of the recording medium P. In this case, the trailing end of the recording medium P is a reference position for the recording medium P. Therefore, the feed roller 11 is closer to the trailing end of the recording medium P than the leading end of the recording medium P, for example.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A sheet loader comprising:

a pair of first regulators disposed movable in a width direction of a recording medium loaded on the sheet loader and configured to contact a side end of the recording medium and regulate a position of the recording medium in the width direction; and a pair of second regulators having one body and another body and configured to be detachably attachable to multiple attachment positions of the sheet tray selectably, the one body and the other body of the pair of second regulators having bilaterally symmetrical shapes identical to each other.

2. The sheet loader according to claim 1, wherein the pair of second regulators contacts a side end of a training end of the recording medium.

3. The sheet loader according to claim 1, wherein the pair of second regulators includes a claw configured to fit to the sheet loader.

4. The sheet loader according to claim 3, wherein the claw of the pair of second regulators is operational with the pair of second regulators attached to the sheet loader.

5. The sheet loader according to claim 1, wherein at least one of sheet sizes of B4, A3, DLT, and SRA3 is loaded.

6. The sheet loader according to claim 1, further comprising a locking portion configured to be locked to the sheet feeder at both lateral ends of the pair of second regulators.

7. An image forming apparatus comprising:

the sheet loader according to claim 1; and an image forming device configured to form an image on the recording medium fed from the sheet loader.

8. The sheet loader according to claim 1, further comprising multiple locking recesses, wherein the pair of second regulators includes:

a horizontal portion extending in a forward and a backward direction; and multiple locking portions projecting toward a left and a right direction, wherein the multiple locking recesses are configured to lock the multiple locking portions.

9. The sheet loader according to claim 8, wherein the multiple locking recesses are provided opposing to corresponding names of respective paper sizes.

10. The sheet loader according to claim 1, further comprising multiple fitting openings, wherein the pair of second regulators includes an engaging claw portion configured to be fitted to a selected one of the multiple fitting openings.

* * * * *